United States Patent [19]

Lienau

[11] 4,092,899

[45] June 6, 1978

[54] REAR GATE PEEP SIGHT DEVICE

[75] Inventor: Jeffrey A. Lienau, Huntsville, Ala.

[73] Assignee: The United States of America as represented by the Secretary of the Army, Washington, D.C.

[21] Appl. No.: 784,105

[22] Filed: Apr. 4, 1977

[51] Int. Cl.[2] ..... F41F 3/04

[52] U.S. Cl. ..... 89/1.816; 42/1 S; 89/1.813

[58] Field of Search ..... 89/1.813, 1.816, 1.8, 89/28 A, 41 B, 41 E; 42/1 S; 33/246, 247, 249, 250

[56] References Cited

U.S. PATENT DOCUMENTS

| | | | |
|---|---|---|---|
| 3,122,059 | 2/1964 | Choate et al. | 89/1.813 |
| 3,371,578 | 3/1968 | Choate et al. | 89/1.814 X |
| 3,750,529 | 8/1973 | Reed et al. | 89/1.816 X |
| 3,786,717 | 1/1974 | Vickers et al. | 89/28 A X |
| 3,969,827 | 7/1976 | Ellis | 33/244 X |
| 3,990,355 | 11/1976 | Looger et al. | 89/1.816 |

*Primary Examiner*—David H. Brown

*Attorney, Agent, or Firm*—Nathan Edelberg; Robert P. Gibson; James T. Deaton

[57] ABSTRACT

A rear gate peep sight device built into discharge firing mechanism for a lightweight portable rocket launcher by incorporating a rear peep into a cover for the firing mechanism. The rear peep is used with a front reticle mounted at one end of the rocket launch to aim or align the rocket launcher with a target. The cover is mounted to the firing mechanism and folds down to cover the firing mechanism safety and firing button.

6 Claims, 5 Drawing Figures

REAR GATE PEEP SIGHT DEVICE

DEDICATORY CLAUSE

The invention described herein may be manufactured, used, and licensed by or for the Government for governmental purposes without the payment to me of any royalties thereon.

CROSS REFERENCE TO RELATED APPLICATIONS AND PATENTS

This application is related to applicant's copending applications Ser. No. 784,106, filed Apr. 4, 1977 and Ser. No. 779,220, filed Mar. 18, 1977 which illustrate and disclose firing mechanisms of the types that can be used with this invention. U.S. Pat. No. 3,990,355 which issued Nov. 9, 1976 and No. 3,890,879 which issued June 24, 1975 each illustrate prior art launcher sight devices.

BACKGROUND OF THE INVENTION

In recent years there has been developed folding fin stabilized rockets which can be fired by one man from a lightweight portable launcher. The rockets normally have a high explosive warhead and are extremely useful against tanks and vehicles. Since the launcher must be portable, weight is a prime consideration in such launcher design. Additionally, the launcher must have a relatively long shelf life.

The rocket launcher essentially comprises a long thin wall open end tube or barrel which is proportioned to receive a rocket. The launcher may be man transportable and capable of being fired from an individual's shoulder or from other conventional support structures. The tube may be of the telescoping type so as to provide a length which is sufficiently greater than the rocket so that the propellant blast of the rocket will have substantially subsided before the rocket leaves the tube.

The sights for rocket launchers are composed of a rear peep and a front reticle. In the past the rear peep sight has been mounted to the launcher and a separate cover used to protect it, additionally the firing mechanism requires a cover to protect it when not in use. To safe the weapon the sight must be closed and covered, and the firing mechanism safed and covered. Should the system be used at night the night peep aperture must be placed to the day position. Therefore it can be seen that a simple peep sight mounted to a firing mechanism cover that in one operator motion closes the sight, covers the firing mechanism, resafes the weapon, and resets the day peep is needed.

Accordingly, it is an object of this invention to provide a sight peep in a cover to protect the sight and firing mechanism simultaneously.

Another object of this invention is to provide a device that performs multiple operator motions required by only one motion.

Still another object of this invention is to eliminate components by using the same components for multiple functions.

A further object of this invention is to provide a sight mechanism that can be made almost exclusively of moldable plastic parts.

SUMMARY OF THE INVENTION

In accordance with this invention, a rear gate peep sight is incorporated into firing mechanism for a rocket and includes a rocket launching tube that has two telescoping sections for lengthening the launcher. The peep sight is incorporated into the firing mechanism and both are mounted on the outer surface of the outer section. The rear peep sight and cover are pivotally mounted as a cover for part of the firing mechanism and is snapped to an open pisition to expose a safety and firing button of the firing mechanism. The safety is mounted in the firing mechanism housing and is slidable to allow the firing button to be actuated. The firing button is held in a retracted position by appropriate means between the firing button and the housing for the firing mechanism until it is desired to fire the rocket. The rear peep sight is built into the cover and includes a large opening in the cover for use in sighting at night. One sights through the large opening and aligns a front reticle at one end of the launcher with a target. The cover also has a member pivoted to the cover with a smaller opening therein for being superimposed over the large opening and for aligning the launcher with a target in day light. As can be seen, the cover serves both as a rear peep sight and a cover for the safety and the firing button to protect the safety and firing button and to make the overall launcher much more compact and thereby lighter in weight.

DESCRIPTION OF THE PREFERRED EMBODIMENT

Figure 1:
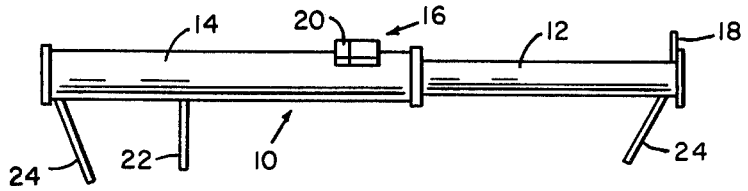
FIG. 1 is a perspective view of a launcher with the sight and firing mechanism thereon according to this invention.
Figure 2:
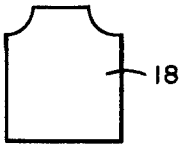
FIG. 2 is an orthographic view of a front sight according to this invention.
Figure 3:
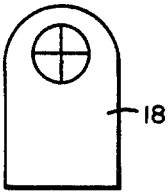
FIG. 3 is an orthographic view of another front sight according to this invention.

Referring now to the drawings, FIG. 1 shows a rocket launcher 10 that has an inner tube 12 and an outer tube 14 that telescope together and as illustrated are in an extended position. Firing mechanism 16 is mounted on the outer surface of tube 14 and includes a rear peep sight and cover device 20 for aligning with front sight 18 and the launcher with a target. This is accomplished by sighting through opening or aperture 104 (see FIG. 5) in member 106 that is pivoted at 105 to align sight 18 with the target. At night member 106 is pivoted clockwise to allow larger opening or aperture 102 to be used in aligning sight 18 with the target. Spring 21 (see FIG. 4) is mounted around shaft 23 that pivotably mounts cover 20 to housing 45 and spring 21 biases peep sight and cover member 20 to the sighting position illustrated in FIG. 5 for accomplishing the sighting operaton. Sight 18 can be of the post type as illustrated in FIG. 2, of the cross hair type as illustrated in FIG. 3, or of a reticle pattern type (not shown).

A shoulder rest 22 is also secured in a conventional manner to tube 14 for resting against the shoulder of one who fires a rocket from the rocket launcher. A strap 24 is also connected to inner and outer tubes 12 and 14 for carrying the rocket launcher. Tubes 12 and 14 can be of the telescoping type disclosed in applicant's copending application Ser. Nos. 784,206 and 779,220.

Housing 45 of firing mechanism 16 slidably mounts firing button 42 therein in a conventional manner and safety 52 (see FIG. 5) is slidably mounted in the housing for movement perpendicular to firing button 42 for release of the firing button when desired. End 61 (see FIG. 5) of safety 52 is utilized for movement of the safety to a firing postion which allows firing button 42 to be actuated. The opposite end 64 of safety 52 has a tapered surface 66 which cooperates with detent edge 68 of cover 20 to force safety 52 back into a safe position when the rocket has not been fired and it is desired to close cover 20. Bead 67 cooperates with detent edge 68 to hold cover 20 closed. Further details of firing mechanisms that can be used in this invention are disclosed in copending applications Ser. Nos. 784,106 and 779,220.

Figure 4:
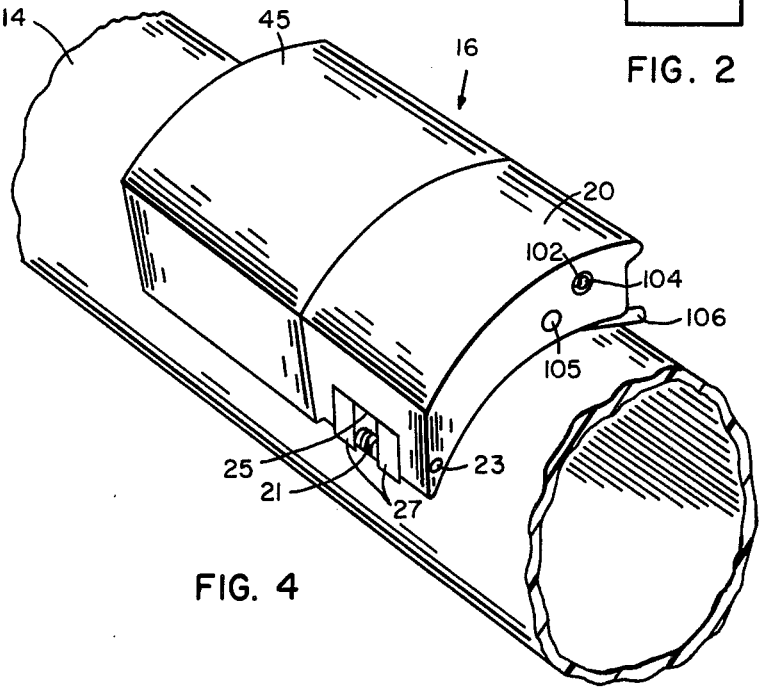
FIG. 4 is a perspective view showing the sight and firing mechanism enlarged with the launcher partially cut away.

With cover 20 closed firing button 42 and safety 52 are covered and protected (FIG. 4). Cover 20 is held down by the friction of detent edge 68 and bead 67 on the firing mechanism housing 45. Forcing cover 20 past bead 67 allows spring 21 to force cover 20 open pivoting on pin 23 until edge 25 comes to rest on firing mechanism housing areas 27. The operator may either use the day peep aperture 104 or the night aperture 102. The night aperture 102 is exposed by pivoting member 106 about pin 105 out of the way to expose night aperture 102. Cover 20 is held open by spring 21 and the edge 25 touching the firing mechanism areas 27. As cover 20 is closed and forced to pivot about pin 23 the edge of detent 68 touches tapered surface 66 of end 64 if the weapon is off the safe position. As the cover 20 is forced down, safety 52 is forced into the safe position as cover 20 passes 64. If the night aperture 102 is exposed, cover 20 touches the launch tube 14 and the aperture in member 106 is forced into the original position as cover 20 is closed. Once detent edge 68 locks over bead 67, sight 20 is fixed closed.

Figure 5:
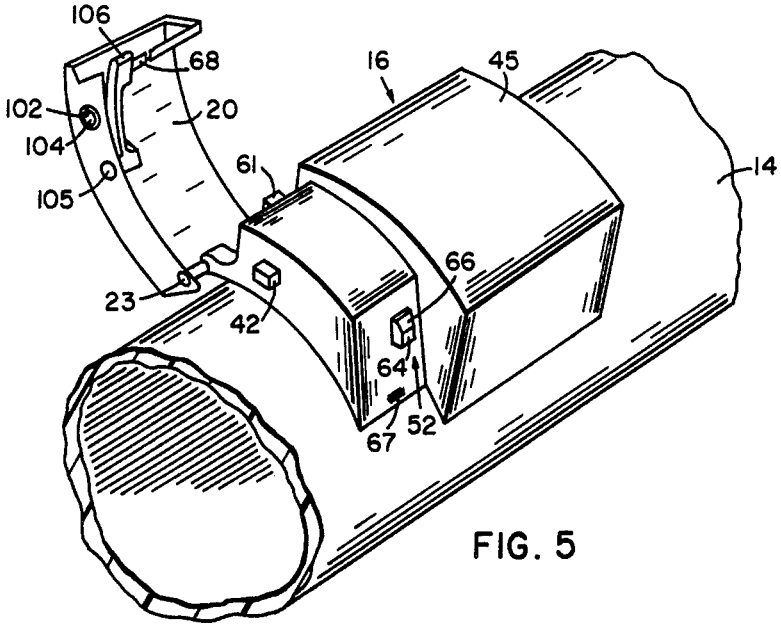
FIG. 5 is another perspective view of the sight and firing mechanism with the peep sight cover in the firing position and illustrating the launching tube partially cut away. de

In operation, rocket launcher 10 is normally telescoped into a retracted position and actuated into an extended position as illustrated in FIG. 1, and then rear peep sight cover 20 is snapped open to release detent edge 68 from bead 67. Spring 21 (see FIG. 4) then biases rear peep sight cover 20 to the position for sighting as illustrated in FIG. 5. With cover 20 in the sighting or launching position and with support 22 at the shoulder of the operator, the operator grasps firing mechanism 16 and aligns his eye to see rear peep opening 102. Aligning the target, front sight 18, rear peep 102, and operator's eye aims the weapon. The operator can then grasp end 61 (see FIG. 5) of safety 52 to actuate the safety and release firing button 42 for linear movement. The rocket is now ready for firing and is accomplished by continuing to sight through opening 102 in sight gate 20 for night vision or by sighting through opening 104 in pivoted member 106 for day vision. With the rocket launcher aligned with the target, firing button 42 is actuated to cause the firing button to move linearly and actuate mechanism for firing the rocket.

As can be seen, this invention differs from other peep sights by combining functions required in the firing mechanism with the sight. With the sight cover open, the firing mechanism and peep sight function normally. Closing the peep sight cover automatically safes the firing mechanims and positions the peep sight to the day aperture. With cover 20 closed, the peep sight cover incloses the firing button and safety and the firing mechanism body structurally supports the peep sight cover aiding it in maintaining alignment.

I claim:

1. A rear gate peep sight device comprising a launcher; a front sight mounted adjacent one end of said launcher; a firing mechanism mounted on said launcher, said firing mechanism including a safety and a firing button for firing a rocket; and a cover mounted on said firing mechanism and inclosing said safety and said firing button when in a closed position, said cover being movable to an open position, said cover having a rear peep sight built therein and alignable with said front sight mounted on said launcher for aligning said launcher with a target.

2. A rear gate peep sight device as set forth in claim 1, wherein said rear peep sight includes a member pivoted on said cover and having an opening therein for sighting through to align with said front sight and aim said launcher at a target, and said cover having a larger opening therein than that of said pivoted member to which the opening in said pivoted member can be aligned concentrically.

3. A rear gate peep sight device as set forth in claim 2, wherein said front sight is a post type sight.

4. A rear gate peep sight device as set forth in claim 2, wherein said front sight is a cross hairs type sight.

5. A rear gate peep sight device as set forth in claim 2, wherein said cover is spring biased to an open position, and wherein said cover has an edge thereon that cooperates with a bead on said firing mechanism to hold said cover in a closed position.

6. A rear gate peep sight device as set forth in claim 5, wherein said safety has an end that projects through the housing of said firing mechanism when said safety has been actuated to allow the firing button to be actuated, and said edge of said cover cooperating with said projecting end of said safety to reset said safety to a safe position when said cover is closed with said firing button being in an unfired position.

* * * * *